US006713962B2

(12) United States Patent
Nohara et al.

(10) Patent No.: US 6,713,962 B2
(45) Date of Patent: Mar. 30, 2004

(54) HIGH-PRESSURE DISCHARGE LAMP

(75) Inventors: Hiroshi Nohara, Nishinomiya (JP); Yoshiharu Nishiura, Otsu (JP); Takashi Maniwa, Takatsuki (JP); Hiroshi Enami, Nishinomiya (JP); Shiki Nakayama, Takatsuki (JP); Masato Wada, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/272,610

(22) Filed: Oct. 16, 2002

(65) Prior Publication Data

US 2003/0085657 A1 May 8, 2003

(30) Foreign Application Priority Data

Oct. 17, 2001 (JP) ..... 2001-319523
Oct. 17, 2001 (JP) ..... 2001-319524

(51) Int. Cl.[7] ..... H01J 17/18
(52) U.S. Cl. ..... 313/623; 313/25
(58) Field of Search ..... 313/25, 623, 624, 313/625, 243

(56) References Cited

U.S. PATENT DOCUMENTS 6,057,646 A 5/2000 Pieroth et al.

FOREIGN PATENT DOCUMENTS

| | | |
|---|---|---|
| JP | 10-31978 | 2/1998 |
| JP | 11-154493 | 6/1999 |
| JP | 2000-100385 | 4/2000 |

*Primary Examiner*—Vip Patel

(57) ABSTRACT

A high-pressure discharge lamp includes: an arc tube that is made from a translucent ceramic material and composed of a main-tube part in which a discharge space is formed and thin-tube parts extending from both ends of the main-tube part; and a pair of electrodes having rods respectively extending from the two thin-tube parts into the discharge space so that the tops face each other with a distance in-between. The rod of at least one of the electrodes is held by a tubular electrode holder made of a halide-resistant metal embedded in and bonded to the thin-tube part via an adhesive agent including a sintered halide-resistant metal impregnated with mixture glass. The electrode holder is at such a position that satisfies "L≧0.012P+2.5 [mm]", where "L" is distance [mm] between the electrode top and one end of the electrode holder closer to the discharge space, and "P" is lamp wattage [W].

15 Claims, 12 Drawing Sheets

FIG.12

| OUTER SURFACE TEMPERATURE [°C] | 740 | 800 | 850 | 900 | 930 | 950 | 970 | 990 |
|---|---|---|---|---|---|---|---|---|
| NON-SEALING LENGTH [mm] | 14.0 | 11.0 | 9.2 | 6.9 | 4.3 | 2.0 | 1.0 | 0.5 |

HIGH-PRESSURE DISCHARGE LAMP

BACKGROUND OF THE INVENTION (1) Field of the Invention

The present invention relates to a high-pressure discharge lamp, and particularly to a technique for hermetically sealing tube end parts of an arc tube that is made from a translucent ceramic material.

(2) Related Art

As a typical material for an arc tube used in a metal halide lamp that is one type of a high-pressure discharge lamp, silica glass has been conventionally used. In recent years, however, an arc tube made from a translucent ceramic material has been developed and commercialized. Because translucent ceramic has a higher heat resistance than silica glass, a metal halide lamp using a translucent ceramic arc tube can be lit at higher temperatures and can exhibit better lamp characteristics such as color rendering properties than a metal halide lamp using a silica glass arc tube.

In the commercialization process, however, such a translucent ceramic arc tube was found to require a relatively long total length for the following reason. A frit-sealing technique is employed to seal a translucent ceramic arc tube. Here, ceramic cement (frit) is used as a sealing material. At high temperatures, such a frit reacts with a metal halide that is a light-emitting material used in the arc tube. To prevent this reaction from occurring, parts (tube end parts) to be sealed using the frit need to be positioned away from a high-temperature part (a discharge space).

The resulting long arc tube inevitably degrades the compactness of a metal halide lamp as a whole. Further, the heat capacity of such long arc tube as a whole is high, thereby degrading the luminous efficiency and failing to satisfy the recent demands for energy-saving.

In view of this, a technique for sealing by way of metallizing (hereafter referred to as a "metallize-sealing technique") as disclosed in Japanese Laid-open Patent Application Nos. 2000-100385 and 2001-58882 is now calling attentions as a new sealing technique. A sealing part formed according to the metallize-sealing technique has been known to be less reactive to a metal halide and to provide stronger sealing than a sealing part formed according to the above frit-sealing technique. Particular techniques disclosed in the above-cited applications further enable thermal shock resistance to be improved by providing an impregnated glass phase in each sealing part formed according to the metallize-sealing technique.

However, these disclosed techniques are found to have various problems. An excessively shortened arc tube with both sealing parts being too close to a high-temperature part may suffer from such a problem that its inner surface is blackened and thereby the luminous flux is greatly degraded. The excessively shortened arc tube with both sealing parts being too close to a high-temperature part may also suffer from such problems that its sealing parts are cracked, and that luminescent colors are changed due to a material for the impregnated glass phase being eroded by a metal halide that is a light-emitting material used in the arc tube.

SUMMARY OF THE INVENTION

The first object of the present invention is to provide a high-pressure discharge lamp that can use an arc tube whose total length is as short as possible and that can prevent such a problem as blackening of the arc tube. The second object of the present invention is to provide a high-pressure discharge lamp that can use an arc tube whose total length is as short as possible and that can prevent such problems as crack generation and luminous color change.

The first object of the present invention can be achieved by a high-pressure discharge lamp, including: an arc tube that is made up of a main-tube part in which a discharge space is formed, and two thin-tube parts extending from both ends of the main-tube part, the main-tube part and the two thin-tube parts being made from a translucent ceramic material; and a pair of electrodes having rods that respectively extend through the two thin-tube parts into the discharge space so that tops thereof face each other with a predetermined distance in-between, the rod of at least one of the electrodes being held by a tubular electrode holder embedded in and bonded to the thin-tube part via an adhesive agent, the electrode-holder being made of a halide-resistant metal, the adhesive agent including a sintered halide-resistant metal impregnated with mixture glass, wherein the electrode holder is at such a position that satisfies the expression "$L \geqq 0.012P+2.5$ [mm]" where "L" is a distance [mm] between (a) a top of the electrode whose rod is held by the electrode holder and (b) one end of the electrode holder closer to the discharge space, and "P" is a lamp wattage [W].

According to this construction, a glow discharge is not generated from the end of the conductive electrode holder at the discharge space side when the lamp is started. Therefore, the blackening phenomenon of the inner surface of the arc tube can be prevented during the effective lifetime of the lamp. Further, the thin-tube part can be shortened in a range of the distance "L" calculated using the above expression, so that the luminous efficiency can be improved as compared with a conventional lamp employing the frit-sealing technique.

The second object of the present invention can be achieved by a high-pressure discharge lamp, including: an arc tube that is made up of a main-tube part in which a discharge space is formed, and two thin-tube parts extending from both ends of the main-tube part, the main-tube part and the two thin-tube parts being made from a translucent ceramic material; and a pair of electrodes having rods that respectively extend through the two thin-tube parts into the discharge space so that tops thereof face each other with a predetermined distance in-between, the rod of at least one of the electrodes being held by a tubular electrode holder embedded in and bonded to the thin-tube part via an adhesive agent, the electrode holder being made of a halide-resistant metal, the adhesive agent including a sintered halide-resistant metal impregnated with mixture glass, wherein a temperature of one end, closer to the discharge space, of a bonding area formed using the adhesive agent does not exceed a lowest temperature at which an erosion action of a light-emitting material enclosed in the discharge space on the mixture glass occurs. The second object of the present invention can also be achieved by a high-pressure discharge lamp, including: an arc tube that is made up of a main-tube part in which a discharge space is formed, and two thin-tube parts extending from both ends of the main-tube part, the main-tube part and the two thin-tube parts being made from a translucent ceramic material; and a pair of electrodes having rods that respectively extend through the two thin-tube parts into the discharge space so that tops thereof face each other with a predetermined distance in-between, the rod of at least one of the electrodes being held by a tubular electrode holder embedded in and bonded to the thin-tube part via an adhesive agent, the electrode holder being made of a halide-resistant metal, the adhesive agent including a sintered halide-resistant metal impregnated with mixture glass, wherein the adhesive agent is at such a position that is away from a top of the electrode whose rod is held by the electrode holder, by a distance that is out of a range where the mixture glass receives an erosion action of a light-emitting material enclosed in the discharge space at steady lighting.

According to these constructions, such a problem that the light-emitting material enclosed in the discharge space erodes the mixture glass at steady lighting can be prevented. Therefore, cracking damage in the art tube or luminous color change can be prevented, enabling the luminous efficiency to be improved.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 12 is a graph showing the correspondence between an outer surface temperature of a metallize-sealing end and a non-sealing length "Lx" used in a luminous-efficiency comparing test.

DESCRIPTION OF THE PREFERRED EMBODIMENTS

The following describes a high-pressure discharge lamp of the present invention, based on a metal halide lamp that is one type of a high-pressure discharge lamp, with reference to the drawings.

(First Embodiment)

Figure 1:
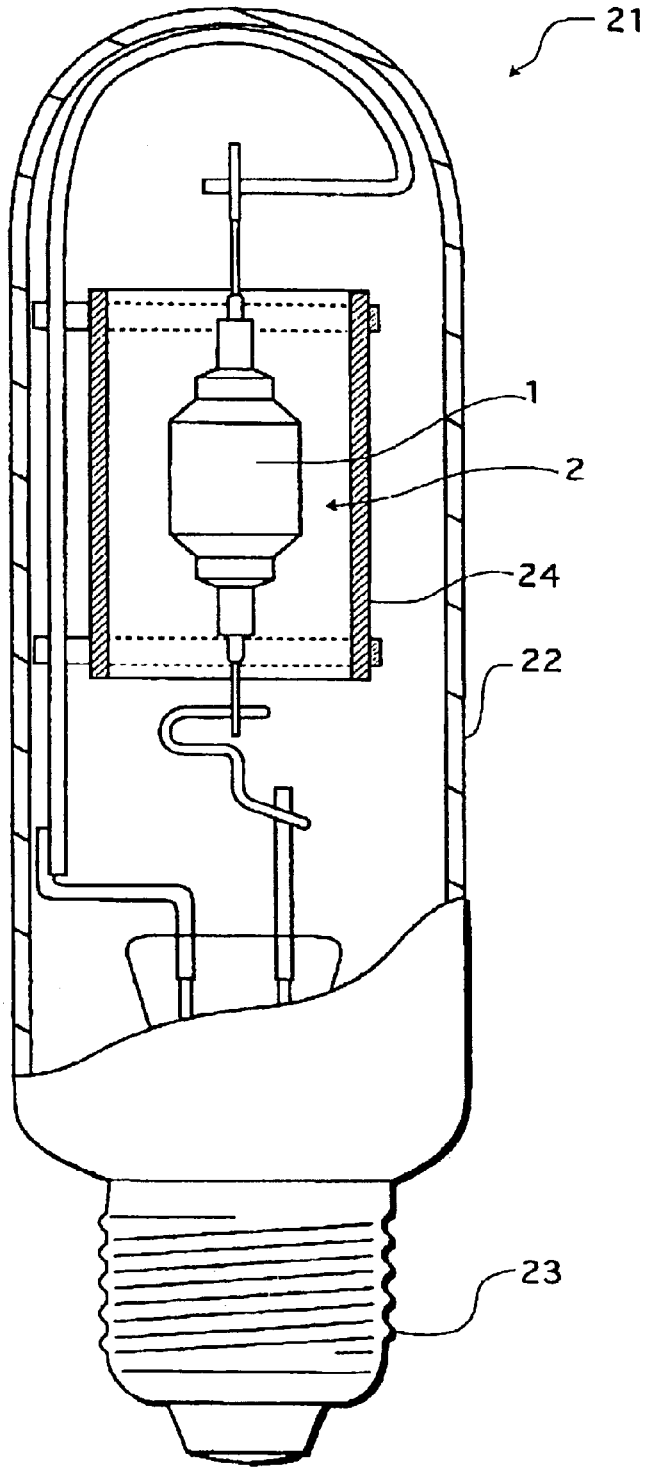
FIG. 1 is a partly sectional view showing the overall construction of a 150 W metal halide lamp according to a first embodiment of the present invention.

FIG. 1 is a partly cutaway view of a metal halide lamp 21 according to the present embodiment.

The metal halide lamp (hereafter simply referred to as the "lamp") 21 has a rated lamp wattage of 150 W, and is used for general interior lighting.

As shown in FIG. 1, the lamp 21 has the following construction. A light-emitting unit 2 that includes an arc tube 1 is housed in an outer tube bulb 22 that is equipped with a base 23. Also, in the outer tube bulb 22, a shielding silica tube 24 is provided so as to surround the arc tube 1 for the purpose of preventing the outer tube bulb 22 from being damaged. The outer tube bulb 22 is made from silica glass or hard glass. A gas, mainly a nitrogen, is enclosed in the outer tube bulb 22.

Figure 2:
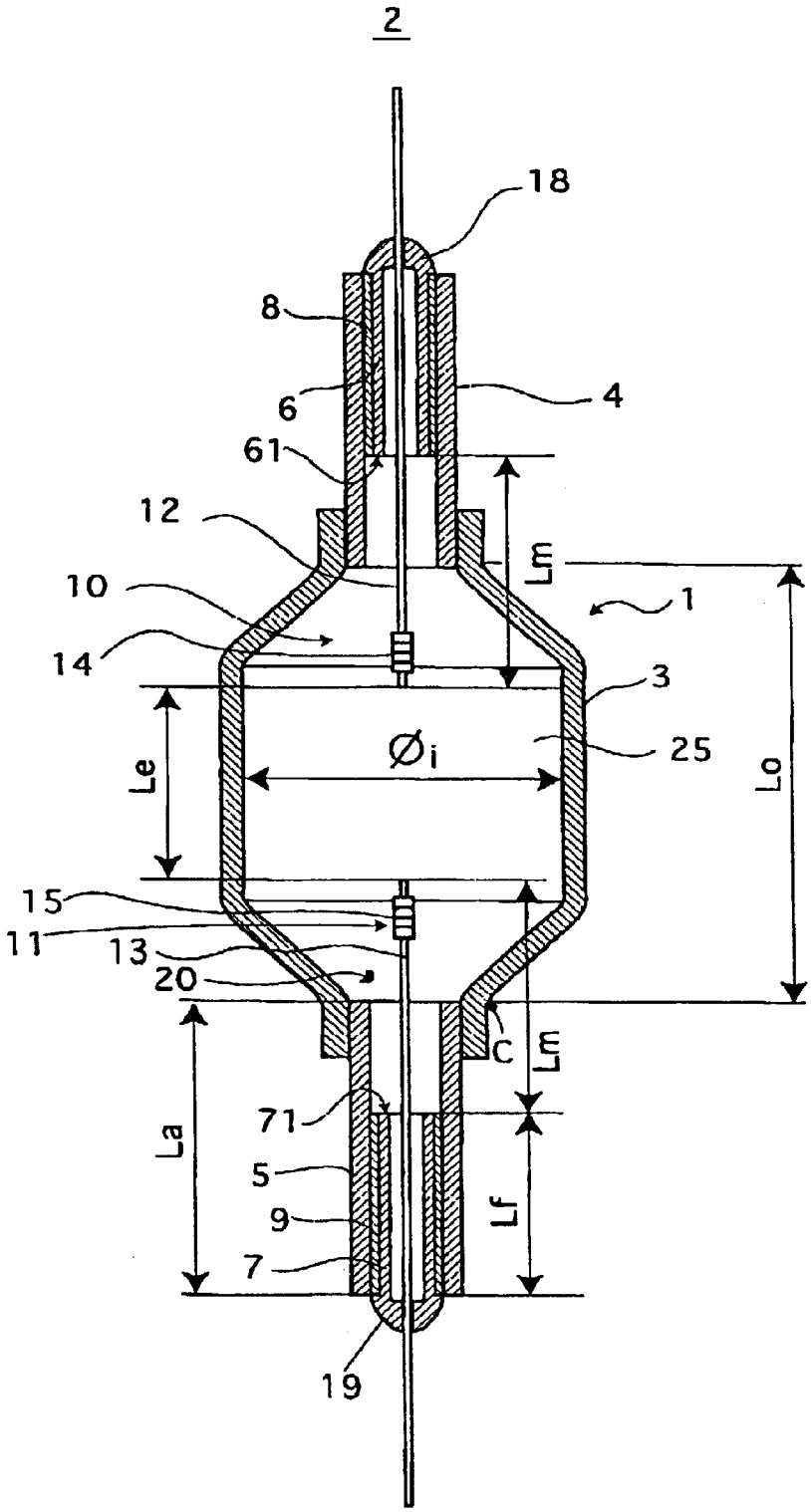
FIG. 2 is a sectional view showing the construction of a light-emitting unit of the metal halide lamp.

FIG. 2 is a longitudinal sectional view of the light-emitting unit 2.

As shown in the figure, the light-emitting unit 2 includes the arc tube 1 that is composed of a main-tube part 3, and thin-tube parts 4 and 5 that respectively extend from both ends of the main-tube part 3. The thin-tube parts 4 and 5 have a smaller diameter than the main-tube part 3. The main-tube part 3 and the thin-tube parts 4 and 5 are made from a translucent polycrystal alumina ceramic material that has a heat resistance of approximately 1200° C. A discharge space is formed in the main-tube part 3. The thin-tube parts 4 and 5 respectively hold axis parts (tungsten electrode rods 12 and 13) of tungsten electrodes 10 and 11. Further, predetermined amounts of (a) a light-emitting material 20 composed of metal halides ($DyI_3$+$TmI_3$+$HoI_3$+T1I+NaI), (b) mercury as a buffer gas, and (c) argon as a starting-aid rare gas, are enclosed in the arc tube 1.

The tungsten electrodes (hereafter simply referred to as the "electrodes") 10 and 11 are respectively composed of the tungsten electrode rods (hereafter simply referred to as "electrode rods") 12 and 13, and tungsten coils 14 and 15 set around one ends of the electrode rods 12 and 13.

The electrodes 10 and 11 are respectively held by the thin-tube parts 4 and 5 via molybdenum capillaries 6 and 7. In detail, the electrode rods 12 and 13 that are the axis parts of the electrodes 10 and 11 are passed through the molybdenum capillaries 6 and 7 that function as electrode holders. The molybdenum capillaries 6 and 7 are literally made of molybdenum, which is a halide-resistant metal. It should be noted here that the electrode rods 12 and 13, and the molybdenum capillaries 6 and 7 are hermetically bonded (sealed) together (to form hermetical bonding parts 18 and 19) by laser-welding at the outlet vicinities of the thin-tube parts 4 and 5. Also, the tungsten coils 14 and 15 are partly melted and bonded to the electrode rods 12 and 13. It should also be noted here that parts of the electrode rods 12 and 13 that extend from the hermetical bonding parts 18 and 19 are used as external lead wires.

The molybdenum capillaries 6 and 7, and the thin-tube parts 4 and 5 are sealed vian adhesive agents 8 and 9 according to a technique for sealing by way of metallizing (hereafter referred to as a "metallize-sealing technique"). The metallize-sealing technique is realized by chemical bonding, and therefore, can form a bonding area that has superior bonding strength and is less reactive with a light-emitting material, as compared with a frit-sealing technique.

Figure 3:
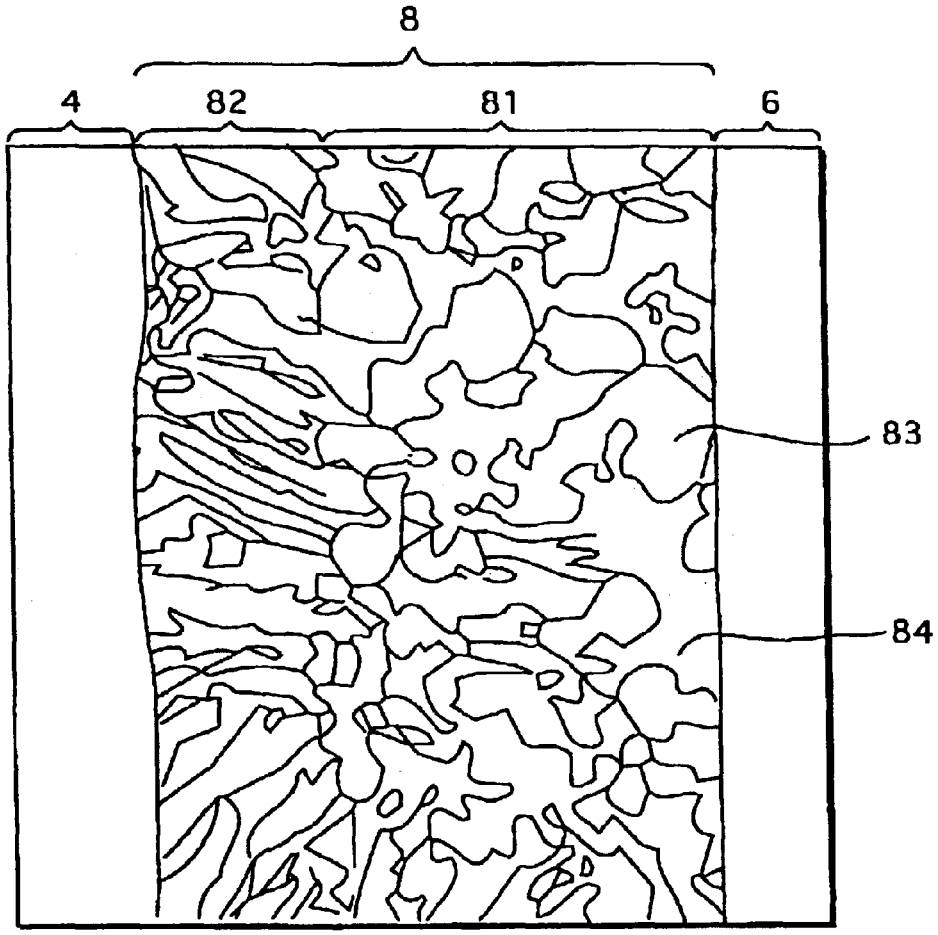
FIG. 3 is a partly enlarged sectional view showing a sealing part sealed via an adhesive agent.

FIG. 3 is a partly enlarged sectional view of a sealing part sealed via the adhesive agent 8. The figure shows in detail a state where the thin-tube part 4 (alumina ceramic) and the molybdenum capillary 6 (molybdenum) are bonded (sealed)

together via the adhesive agent 8. It should be noted here that an adhesive agent 9 used to seal the other sealing part is the same as the adhesive agent 8 and so the following only describes the adhesive agent 8.

As shown in the figure, the adhesive agent 8 is composed of a main layer 81 and an interface glass layer 82. The main layer 81 comes in contact with the molybdenum capillary 6. The interface glass layer 82 is made from $Dy_2O_3$—$Al_2O_3$ glass and is provided at an interface between the thin-tube part 4 and the main layer 81. The main layer 81 is made of sintered metal particles such as molybdenum particles, and is composed of a porous structure 83 that has open pores, and a glass phase 84 impregnated in the open pores. The glass phase 84 is made from $Dy_2O_3$—$Al_2O_3$ mixture glass whose main constituent is $Dy_2O_3$—$Al_2O_3$. It should be noted here that the $Dy_2O_3$—$Al_2O_3$ mixture glass may contain minor constituents such as $La_2O_3$ and $Y_2O_3$. According to the adhesive agent 8 constructed as above, the mixture glass impregnated in the open pores functions as a kind of buffer, and therefore, thermal shock resistance can be improved. To be more specific, the above adhesive agent 8 is characterized by including such a sintered metal having open pores and such mixture glass impregnated in the open pores. It should be noted here that the adhesive agent 8, a manufacturing method for the adhesive agent 8, and a bonding method using the adhesive agent 8 are described in detail in Japanese Laid-open Patent Application No. 2001-58882, and so are not described any further in this specification.

Referring back to FIG. 2, the following gives dimensions of essential components of the light-emitting unit 2 having the above-described construction.

Maximum Inner Diameter of Main-tube Part "ϕi": 10.7 [mm]

Inner Total Length of Main-tube Part "Lo": 15.4 [mm]

Distance between Electrodes "Le": 10.0 [mm]

Total Length of Thin-tube Part "La": 7.0 [mm]

Outer Diameter of Thin-tube Part: 3.2 [mm]

Inner Diameter of Thin-tube Part: 1.30 [mm]

Outer Diameter of Molybdenum Capillary: 1.2 [mm]

Thickness of Molybdenum Capillary: 0.10 [mm]

Wire Diameter of Electrode Rod: 0.5 [mm]

It should be noted here that a length "Lf", in the tube-axis direction (vertical direction in the figure), of a part of the arc tube 1 that is sealed using the metallize-sealing technique in the sealing part (hereafter referred to as a "metallize-sealing length") is 3.5 mm. The metallize-sealing length "Lf" is set at such a value required to ensure good hermetical sealing. Also, a tube wall loading "we" of the arc tube 1 is set at approximately 27 $W/cm^2$.

In this lamp 21, an away distance "Lm", which is a distance in the tube axis direction between a top of the tungsten electrode 10 and an end 61 of the molybdenum capillary 6 at the discharge space side, as well as a distance in the tube axis direction between a top of the tungsten electrode 11 and an end 71 of the molybdenum capillary 7 at the discharge space side, is set at 5.5 mm. The following describes the reasons why the distance "Lm" is set at such a value.

To improve the luminous efficiency using the metallize-sealing technique, the inventors of the present application manufactured by way of experiment a lamp with a length "La" of the thin-tube parts 4 and 5 being set at as short as 4.0 mm. The away distance "Lm" of this experimental lamp was 2.5 mm.

The inventors then conducted a life test on this experimental lamp with a 5.5-hours—on cycle followed by a—0.5-hours off cycle. The initial luminous efficiency of this experimental lamp was 97 lm/W, whereas the initial luminous efficiency of a conventional lamp employing the frit-sealing technique was 90 lm/W, meaning that an expected improvement of approximately 8% was achieved for this experimental lamp. Also, a general color rendering index "Ra" of the experimental lamp was approximately 92, whereas the general color rendering index "Ra" of the conventional lamp employing the frit-sealing technique was approximately 90, also meaning that an improvement was achieved for this experimental lamp. In this test, a temperature "Tc" of an end "C" of the main-tube part 3 was also measured. The temperature "Tc" for the experimental lamp was higher than that for the conventional lamp employing the frit-sealing technique, by approximately 250° C.

These test results can be explained as follows. For the experimental lamp, a heat loss was reduced by shortening the thin-tube parts. Due to the reduced heat loss, the luminous efficiency was improved. Further, a steam pressure of the light-emitting material 20 mainly made of a metal halide was increased. Due to the increased steam pressure, the general color rendering index "Ra" was improved.

However, when 500 hours passed from the start of this life test, blackening of the internal surface of the main-tube part 3 was observed. At this point, the luminous flux was approximately 70% of a value measured when 100 hours passed from the start of the life test. To obtain the reason of this phenomenon, the inventors of the present application examined a state of a discharge at the startup of the lamp, to find out that the discharge started from the molybdenum capillaries 6 and 7 used as conductors. To be more specific, because the ends 61 and 71 of the molybdenum capillaries 6 and 7 at the discharge space side were too close to the discharge space 25 in the experimental lamp, heat escaped outside via the cross sections of the molybdenum capillaries 6 and 7. Due to this, the transition to an arc discharge took long time. During the transition taking long time to the arc discharge, a glow discharge was started from the ends 61 and 71 of the molybdenum capillaries 6 and 7 at the discharge space side, and sputtering at the glow discharge caused molybdenum to be diffused and attached to the inner surface of the main tube 3, thereby blackening the internal surface of the main tube 3. This resulted in the luminous flux being degraded within the effective lifetime of the lamp.

To solve the above problems, the inventors of the present application experimented various methods, and finally found out that a glow discharge was not started from the ends 61 and 71 of the molybdenum capillaries 6 and 7 at the discharge space side when the ends 61 and 71 were positioned away by a predetermined distance from the discharge space 25 in the tube axis direction. To be more specific, the inventors experimented, out of the above listed dimensions of the lamp components, to extend the length "La" of the thin-tube parts 4 and 5 so as to increase the away distance "Lm" without changing the metallize-sealing length "Lf". The inventors actually prepared a number of lamps with the length "La" being set at various values from 4.0 mm ("Lm" being 2.5 mm) to longer, and conducted the above-described life test on each of the prepared lamps.

Figure 4:
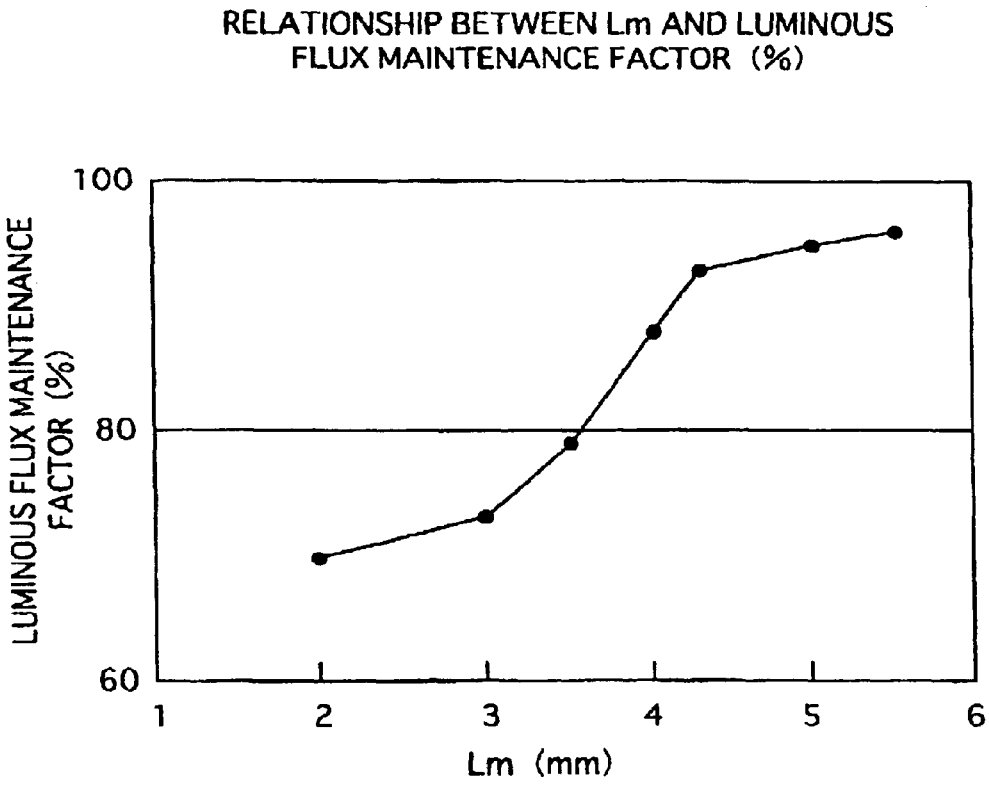
FIG. 4 is a graph showing the relationship between a value of "Lm" and a luminous flux maintenance factor resulting from a life test.

FIG. 4 is a graph showing the relationship between a value of "Lm" and a luminous flux maintenance factor after 500 hours, resulting from the life test.

As can be seen from the figure, the luminous flux maintenance factor increases as the away distance "Lm" increases, meaning that the blackening phenomenon is reduced as the away distance "Lm" increases. These test results confirm that a glow discharge is not generated at all from the ends 61 and 71 of the molybdenum capillaries 6 and 7 when the away distance "Lm" is 4.3 mm or more. The luminous flux maintenance factor of the lamp with the away distance "Lm" being 4.3 mm measured after 500 hours is 93% of a value measured after 100 hours. The luminous flux maintenance factor of this lamp with the away distance "Lm" being 4.3 mm shows a great improvement, as compared with the luminous flux maintenance factor of the first experimental lamp (with the away distance "Lm" being 2.5 mm) being approximately 70%. Further, the luminous flux maintenance factor of this lamp after 6000 hours was 75%. Also, the initial luminous efficiency of this lamp was 94.5 lm/W, showing an improvement of approximately 5% as compared with a conventional lamp. These test results confirm therefore that this lamp with the away distance "Lm" being 4.3 mm is free from defectives caused by luminescent colors changed due to blackening of the inner surface of the main-tube part 3, and that this lamp also achieves the object of improved luminous efficiency.

To sum up, a 150 W lamp shows improved luminous efficiency but suffers from the blackening phenomenon, when the away distance "Lm" is 4.3 mm or less.

The inventors of the present application also conducted the same life test on lamps with various wattages other than the 150 W lamp, to obtain a minimum value for the away distance "Lm" that can still prevent the blackening phenomenon for each of the lamps with various wattages. For 20 W, 35 W, 70 W, 100 W, 250 W, and 400 W lamps, such minimum values for the away distance "Lm" were found to be 2.6 mm, 2.9 mm, 3.3 mm, 3.7 mm, 5.4 mm, and 7.2 mm, respectively.

Figure 5:
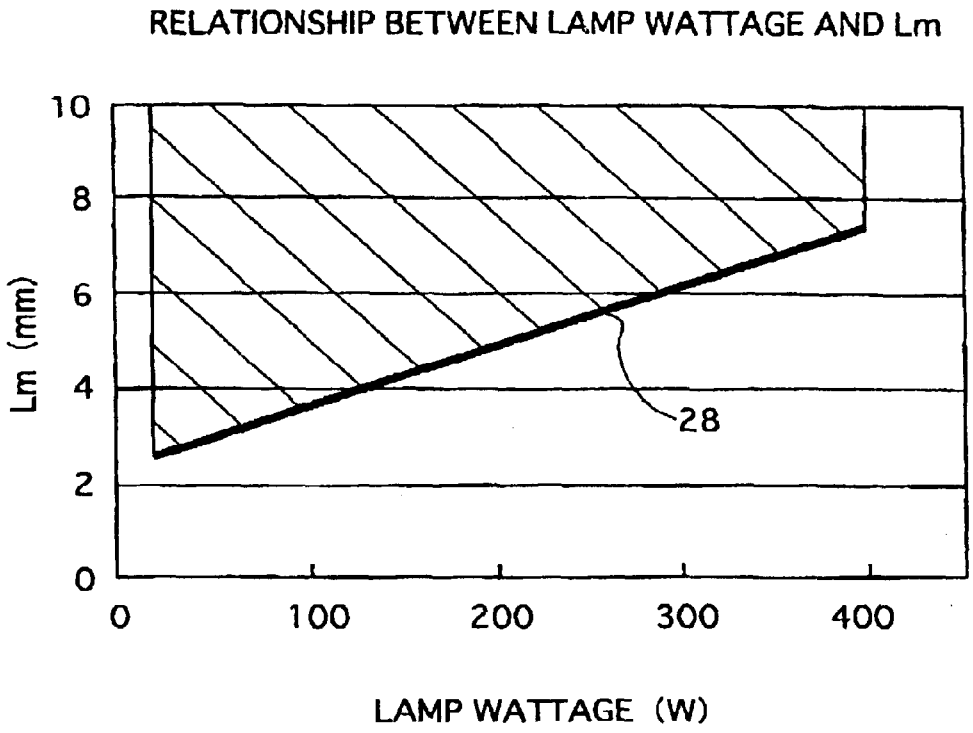
FIG. 5 is a graph showing the relationship between a lamp wattage and a value of "Lm" resulting from a life test.

FIG. 5 is a graph showing the relationship between a lamp wattage and a minimum value for "Lm", resulting from the above life test.

As can be seen from the figure, the minimum value for the away distance "Lm" for each lamp wattage [W] can be plotted substantially as a straight line 28. Therefore, the relational expression for the minimum value for the away distance "Lm" and the lamp wattage "P" can substantially be written using the linear function "Lm=0.012P+2.5[mm]".

This expression shows that the minimum value for the away distance "Lm" increases as the lamp wattage increases. This can be explained as follows. For high-pressure discharge lamps such as metal halide lamps, the electrode distance "Le" is usually shorter as the lamp wattage is smaller, and vice versa. The shorter electrode distance "Le" means a higher probability of an arc discharge being started from the tops of the tungsten electrodes. In other words, the longer electrode distance "Le" means a higher probability of a glow discharge being started. For a lamp with a small wattage, the electrode distance "Le" is short, and therefore a glow discharge is not likely to be started from the ends 61 and 71 of the molybdenum capillaries 6 and 7 at the discharge space side even if the away distance "Lm" is set short. For a lamp with a larger wattage, on the other hand, the electrode distance "Le" is longer, and therefore a glow discharge is more likely to be generated, unless the away distance "Lm" is set longer.

As described above, for each of the lamps with various wattages, the blackening phenomenon can be prevented by setting the away distance "Lm", as the minimum, at such a value that is calculated using the above expression. On the other hand, if the away distance "Lm" is set at a value larger than necessary, the luminous efficiency may be contrarily degraded due to a heat loss. Therefore, it is preferable to set the away distance "Lm" at an optimum value determined considering various factors such as the lamp dimension, and the luminous efficiency and the luminous flux maintenance factor within its effective lifetime. As one example, it is preferable to set the away distance "Lm" at a value selected from a diagonally shaded area in FIG. 5.

The inventors of the present application prepared a 150 W lamp with the away distance "Lm" being set at 5.5 mm and the length "La" being set at 7.0 mm. The inventors then measured the initial lamp characteristics of the lamp, namely, the initial luminous efficiency and the general color rendering index, and conducted the above life test on the lamp. According to the test results, the initial luminous efficiency was 95 lm/W and the general color rendering index was 91.4. The blackening phenomenon did not occur until 6000 hours passed from the start of the life test. Further, because of improved thermal shock resistance due to the adhesive agents 8 and 9 containing mixture glass, damages and leaks of the thin-tube parts 4 and 5 and changes in luminescent colors did not occur until 6000 hours passed from the start of the life test.

According to the present embodiment described above, the away distance "Lm" that is a distance between the top of the tungsten electrode and the end of the molybdenum capillary at the discharge space side is to be set at an optimum value based on the above expression. By doing so, the blackening phenomenon of the inner surface of the arc tube can be prevented during the effective lifetime of the lamp, thereby producing the effect of improving the luminous efficiency.

It should be noted here that the application of the above relational expression for the lamp wattage [W] and the minimum value for the away distance "Lm" [mm] should not be limited to lamps with lamp wattages of 400 W and smaller. Although not shown in FIG. 5, the above relational expression can be applied to lamps with larger lamp wattages than 400 W, e.g., a 1 KW lamp and a 2 KW lamp.

(Second Embodiment)

A metal halide lamp according to the present embodiment differs from the metal halide lamp according to the first embodiment only in that members made of molybdenum as a halide-resistant metal (hereafter referred to as "molybdenum coils") are wound around the electrode rods 12 and 13. The following describes the present embodiment focusing only on its differences from the first embodiment. Here, components of the metal halide lamp according to the present embodiment that are the same as the components of the metal halide lamp according to the first embodiment are given the same reference numerals in the figures and are not described in the present embodiment.

Figure 6:
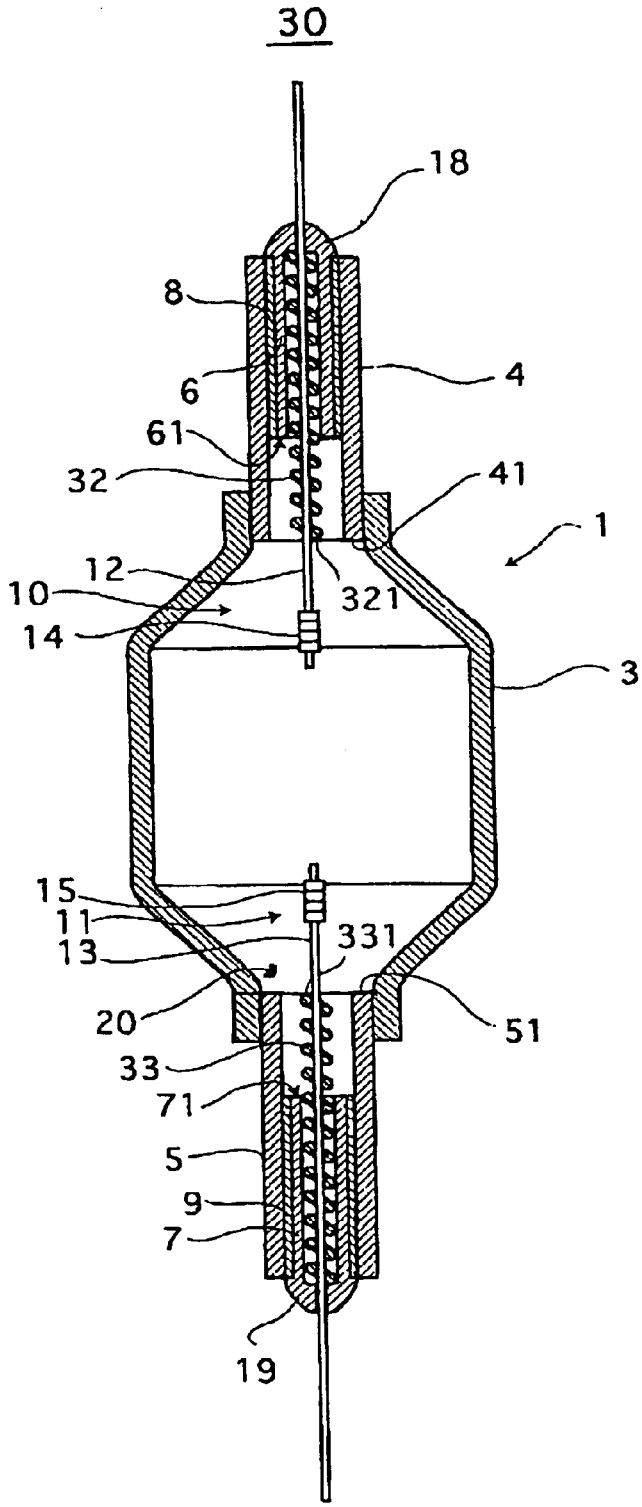
FIG. 6 is a sectional view showing the construction of a light-emitting unit according to a second embodiment of the present invention.

FIG. 6 shows the construction of a light-emitting unit 30 according to the present embodiment.

As shown in the figure, a molybdenum coil 32 is set around the electrode rod 12 and a molybdenum coil 33 is set around the electrode rod 13. In this way, a gap formed between a tungsten electrode axis and the thin-tube part, and a gap formed between the tungsten electrode axis and the molybdenum capillary are bridged for the following improvement.

With such a construction where the thin-tube parts 4 and 5 are provided at both ends of the main-tube part 3 as in the present embodiment, the light-emitting material 20 enclosed in the arc tube 1 mostly exists in a liquid-state within the main-tube part 3. However, a portion of the light-emitting material 20 flows into the thin-tube parts 4 and 5 and into molybdenum capillaries 6 and 7. The portion of the light-emitting material 20 accumulated in the thin-tube parts 4 and 5 and in the molybdenum capillaries 6 and 7 is not used for the original purpose of emitting light. To obtain stable luminescent colors, therefore, a larger amount of light-emitting material than required to emit light for compensating for such a loss needs to be enclosed into the arc tube 1. This means that a larger amount of light-emitting material than required to emit light is to be used.

As one method for reducing a total amount of light-emitting material to be enclosed into the arc tube 1 by reducing an amount of such a portion flowing into the thin-tube parts 4 and 5 and into the molybdenum capillaries 6 and 7, members made of a halide-resistant metal are to be provided to narrow a space formed around the electrode rod 12 and a space formed around the electrode rod 13. To be specific, the members are provided to bridge a gap formed between the electrode rod 12 and the thin-tube part 4 and between the electrode rod 12 and the molybdenum capillary 6, and a gap formed between the electrode rod 13 and the thin-tube part 5 and between the electrode rod 13 and the molybdenum capillary 7. Such members can block the light-emitting material flowing into these gaps. If coil members are used as the members for bridging these gaps, cross-sectional areas of the members are relatively small and therefore heat is difficult to escape via the coil members, as compared with when for example tubular members are used. In this case, therefore, such a problem does not occur that the transition to an arc discharge takes long time.

The life test was conducted on such a lamp that has the above-described construction. According to the test results, almost no influence by sputtering was observed and the blackening phenomenon due to diffused molybdenum did not occur. Further, the total amount of light-emitting material to be enclosed in the arc tube 1 of such a lamp was approximately 30% less than that for a lamp without the molybdenum coils 32 and 33.

Here, a coil member can be prepared simply by winding a wire around each of the electrode rods 12 and 13, whereas, it is not easy to manufacture, for example, a tubular member because the tubular member should be precisely manufactured in such a manner that its inner diameter is larger than the outer diameter of each of the electrode rods 12 and 13 and its outer diameter is smaller than the inner diameter of each of the molybdenum capillaries 6 and 7.

To effectively prevent the light-emitting material from flowing into the thin-tube parts 4 and 5 and the like, it is preferable to provide the molybdenum coils 32 and 33 around the entire areas of the electrode rods 12 and 13 inserted (positioned) within the thin-tube parts 4 and 5 as shown in the figure.

Also, when ends 321 and 331 of the molybdenum coils 32 and 33 at the discharge space side are positioned, in the tube axis direction, anywhere between (a) the ends 61 and 71 of the molybdenum capillaries 6 and 7 at the discharge space side and (b) ends 41 and 51 of the thin-tube parts 4 and 5 at the discharge space side, the effect can be produced of reducing an amount of light-emitting material flowing into the molybdenum capillaries 6 and 7 and even into the thin-tube parts 4 and 5.

Further, the effect of reducing the total amount of light-emitting material to be enclosed into the arc tube 1 can also be produced to a certain degree, when molybdenum coils are set only partly around the areas of the electrode rods 12 and 13 positioned in the molybdenum capillaries 6 and 7, as compared with the case where the molybdenum coils are not provided.

It should be noted here that at the time of laser-welding, a base end (an end opposite to the discharge space 25) of the molybdenum coil 32 is welded and fixed with the hermetical bonding part 18 within the molybdenum capillary 6, and a base end of the molybdenum coil 33 is welded and fixed with the hermetical bonding part 19 within the molybdenum capillary 7.

Although the present embodiment describes the case where a member made of molybdenum is used as the winding member to be wound around the electrode rod, any member made of a halide-resistance metal can be used as this winding member. For example, a member made of tungsten may be used. The winding member of course should have such a diameter that can be placed in a gap formed between the surface of each of the electrode rods 12 and 13 and the inner surface of each of the molybdenum capillaries 6 and 7. To minimize an amount of light-emitting material flowing into each of the molybdenum capillaries 6 and 7, it is preferable to minimize the gaps formed between the surface of the electrode rods 12 and 13 and the molybdenum capillaries 6 and 7. Therefore, it is preferable that the winding members have such a diameter that allows the surfaces of the winding members wound around the electrode rods 12 and 13 to come in contact with the inner surfaces of the molybdenum capillaries 6 and 7. Also, the winding pitch of the winding members is determined based on a desired degree or the like of reducing an amount of light-emitting material flowing into the molybdenum capillaries 6 and 7.

(Third Embodiment)

Figure 7:
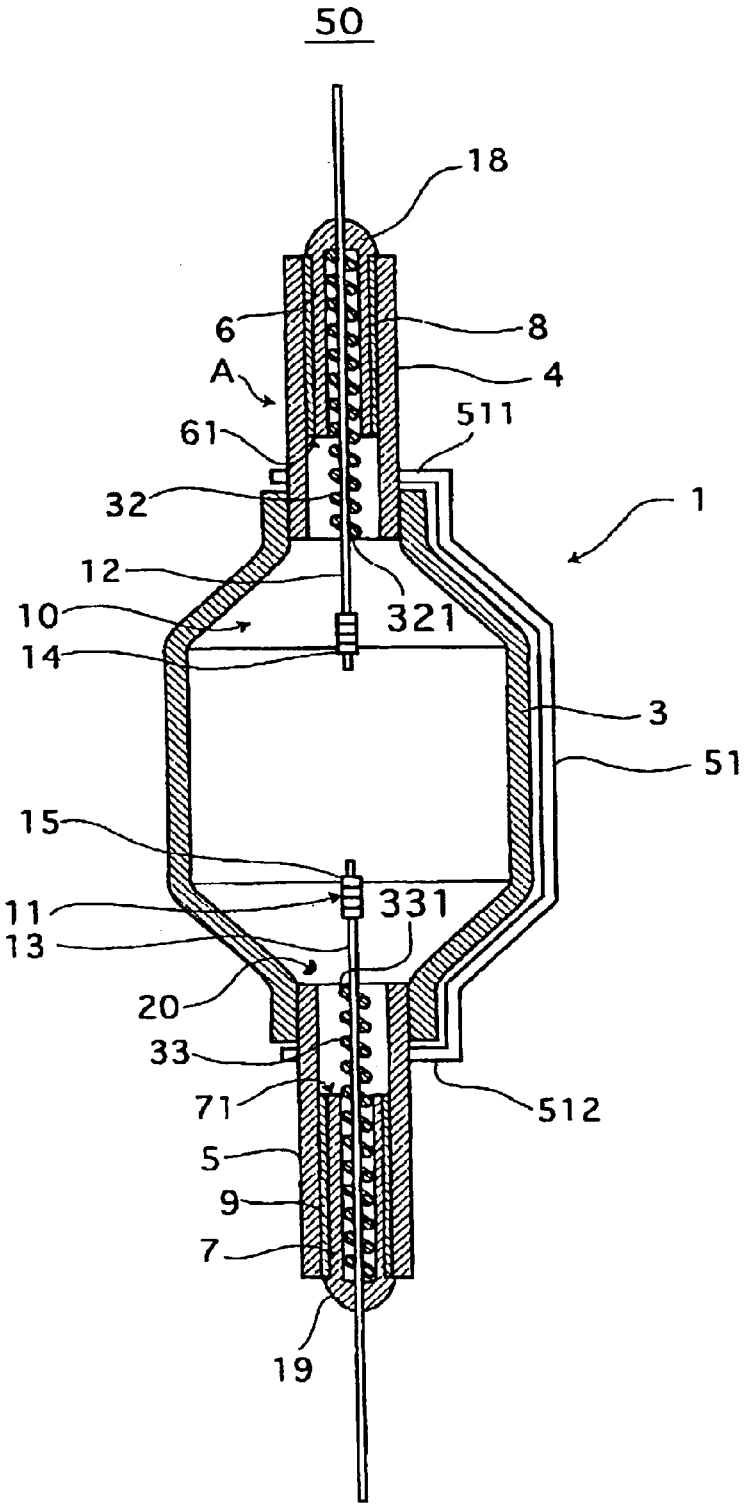
FIG. 7 is a sectional view showing the construction of a light-emitting unit according to a third embodiment of the present invention.

As shown in FIG. 7, a light-emitting unit 50 according to the present embodiment has a construction in which a well-known starting aid conductor 51 is additionally attached to the arc tube 1 in the second embodiment.

As shown in the figure, the starting aid conductor 51 that is attached to the arc tube 1 is made from a wire member, and one attaching end 511 of the starting aid conductor 51 is wound around the thin-tube part 4, and the other attaching end 512 of the starting aid conductor 51 is wound around the thin-tube part 5.

The winding position at which the attaching end 511 is wound around the thin-tube part 4 is away by 2 mm toward the discharge space side in the tube axis direction from the end 61 of the molybdenum capillary 6 at the discharge space side. The winding position at which the attaching end 512 is wound around the thin-tube part 5 is also away by 2 mm toward the discharge space side in the tube axis direction from the end 71 of the molybdenum capillary 7 at the discharge space side.

This is due to the following reasons. When a starting aid conductor is attached to an arc tube, a discharge is started from the closest position to the starting aid conductor at the startup of the lamp. Assume that the attaching end 511 of the starting aid conductor 51 is wound around a position at the thin-tube part 4 indicated by "A" in the figure. In this case, a glow discharge is generated between the attaching end 511 and the molybdenum capillary 6 at the startup of the lamp. The glow discharge may cause the blackening phenomenon of the arc tube.

To enable a discharge to be started from a position at the molybdenum coils 33 and 34 closest to the starting aid conductor 51, i.e., to disable a glow discharge to be started from the molybdenum capillaries 6 and 7, the starting aid conductor 51 is to be attached at such a position that does not cause a glow discharge between the attaching end 511 and the molybdenum capillary 6, and between the attaching end 512 and the molybdenum capillary 7. To be more specific, the attaching end 511 of the starting aid conductor 51 is to be wound around the thin-tube part 4 at a position, in the tube axis direction, between the end 61 of the molybdenum capillary 6 at the discharge space side and the end 321 of the molybdenum coil 32 at the discharge space side, and the attaching end 512 of the starting aid conductor 51 is to be wound around the thin-tube part 5 at a position, in the tube axis direction, between the end 71 of the molybdenum capillary 7 at the discharge space side and the end 331 of the molybdenum coil 33 at the discharge space side.

In this case, because the molybdenum coils 32 and 33 are coil members, diffusion of molybdenum due to sputtering rarely occurs as described above. Therefore, the starting aid conductor can produce the effect of improving the lamp startup properties. Here, the lamp startup properties are better as a discharge at the startup of the lamp is generated closer to the discharge space 25. Considering this, it is preferable that the winding positions at which the attaching ends 511 and 512 are wound around the thin-tube parts 4 and 5 are as close to the discharge space 25 as possible.

It should be noted here that although the present embodiment describes the case where the attaching end 511 of the starting aid conductor 51 is wound around the thin-tube part 4 and the attaching end 512 of the starting aid conductor 51 is wound around the thin-tube part 5, the present invention should not be limited to such, as long as the functions of the starting aid conductor 51 are realized. For example, only the attaching end 511 may be wound around the thin-tube part 4 and the attaching end 512 may be connected to the hermetical bonding part 19. It should also be noted here that the starting aid conductor 51 may not be made from a wire member but may be made from a sheet member, or the like.

(Fourth Embodiment)

Although the above first to third embodiments describe the construction examples that can prevent blackening of the arc tube, the present embodiment describes the construction example that can prevent crack generation and luminescent color change.

Figure 8:
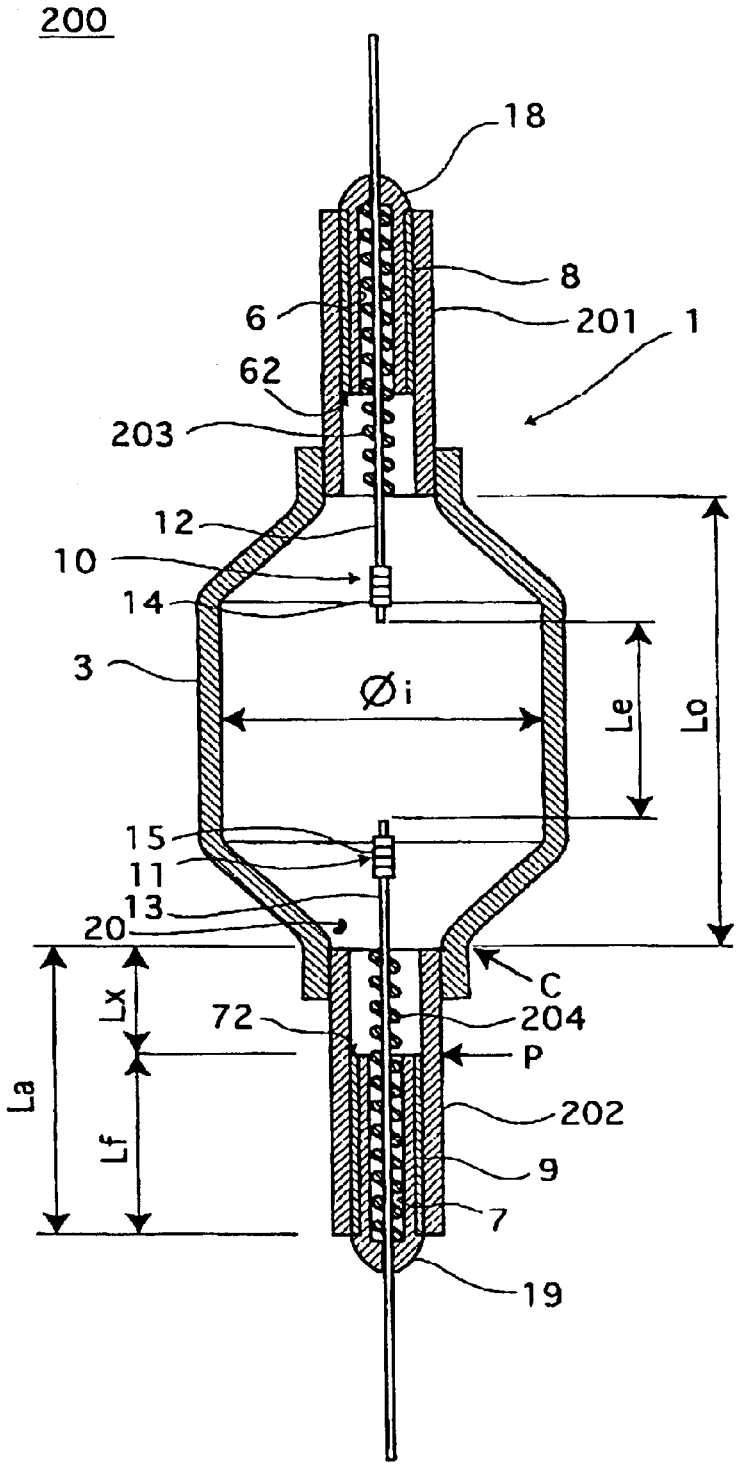
FIG. 8 is a sectional view showing the construction of a light-emitting unit according to a fourth embodiment of the present invention.

FIG. 8 is a longitudinal sectional view of a light-emitting unit 200 according to the present embodiment. The light-emitting unit 200 has basically the same construction as the light-emitting unit 2 according to the first embodiment, with the differences being in that the thin-tube parts 4 and 5 are replaced by thin-tube parts 201 and 202, and that molybdenum coils 203 and 204 are wound around areas of the electrode rods 12 and 13 that are positioned in the thin-tube parts 4 and 5. Also, the thin-tube parts 201 and 202 are different in the length in the tube axis direction (described later), from the thin-tube parts 4 and 5 in the first embodiment. Here, the molybdenum coils 203 and 204 are provided to minimize spaces within the thin-tube parts 201 and 202, and are substantially the same as the molybdenum coils 32 and 33 in the second embodiment. Here, components of the light-emitting unit 200 according to the present embodiment that are the same as the components of the light-emitting unit according to the first embodiment are given the same reference numerals and are not described in the present embodiment.

For such a light-emitting unit 200 that is constructed as shown in FIG. 8, the luminous efficiency is improved further as the heat capacity of the thin-tube parts 201 and 202 is made smaller. The heat capacity of the thin-tube parts 201 and 202 can be adjusted using a method of increasing or decreasing the total length of each of the thin-tube parts 201 and 202 or a method of expanding or reducing the outer diameter of each of the thin-tube parts 201 and 202. The inventors of the present application employed the former method of increasing or decreasing the total length of each of the thin-tube parts 201 and 202. The inventors first manufactured (by way of experiment) a metal halide lamp with the total length of each of the thin-tube parts 201 and 202 being extremely short, i.e., 4 mm, and conducted a lighting test on the experimental lamp.

According to the test results, the luminous efficiency of the experimental lamp was 97 lm/W, showing an improvement of approximately 8% as compared with the luminous efficiency being 90 lm/W of a metal halide lamp manufactured according to the frit-sealing technique and having the same rated lamp wattage as the experimental lamp (hereafter referred to as a "comparative lamp"). The luminous efficiency of the experimental lamp was as high as expected. Also, the general color rendering index "Ra" of the experimental lamp was 92, which was higher than the general color rendering index "Ra" being 90 of the comparative lamp. Here, a surface temperature of a main tube end "C" of the experimental lamp, which is an end of the main-tube part and is the coolest position in the main-tube part, was approximately 990° C. at steady lighting. On the other hand, the surface temperature of the main tube end "C" of the comparative lamp at steady lighting was approximately 740° C. This means that the surface temperature of the main tube end "C" of the experimental lamp was higher than that of the comparative lamp by as much as 250° C. These test results reveal that improvements in the luminous efficiency and the general color rendering index "Ra" of the experimental lamp as compared with the comparative lamp can be attributed to the effect of an increased steam pressure of the light-emitting material substantially made of a metal halide.

Here, the inventors of the present application conducted the life test on the above experimental lamp with a 5.5-hours—on cycle followed by a—0.5-hours off cycle. When about 500 hours passed from the start of the test, cracking damage was generated in the vicinity of ends, closer to the discharge space, of the thin-tube parts 201 and 202 corresponding to sealing areas (bonding areas) sealed using the metallize-sealing technique. The cracking damage generation ratio (defective generation ratio) during the rated lifetime of 6000 hours was 27%. These test results reveal the following. Even though the adhesive agents 8 and 9 contain a glass phase (mixture glass) as a buffer, the above problem occurs if they are positioned too close to the discharge space where a heat source exists and are exposed to excessively high temperatures. To be more specific, a difference in the linear expansion coefficient between (a) the adhesive agents 8 and 9 and (b) a translucent ceramic material for the thin-tube parts 201 and 202 causes cracking of the thin-tube parts 201 and 202.

Also, at least during the above rated lifetime, a slow leakage of the sealing parts did not occur, but changes in luminescent colors were observed. The luminescent color change ratio (defective generation ratio) was approximately 4%. Then, the inventors of the present application closely examined the sealing parts of the experimental lamp for which the luminescent color change was observed. At one ends of the sealing parts closer to the discharge space, the $Dy_2O_3$—$Al_2O_3$ glass contained in the adhesive agents 8 and 9 was found to have been eroded by components of the light-emitting material 20, in particular, by NaI, $DyI_3$, and $TmI_3$. The luminescent color change can be attributed to the eroded $Dy_2O_3$—$Al_2O_3$ glass being released into the discharge space. Here, the above erosion phenomenon can be attributed again to the adhesive agents 8 and 9 being positioned too close to the discharge space where a heat source exists and exposed to excessively high temperatures.

Then, the inventors of the present application manufactured experimental lamps each with the metallize-sealing length "Lf" being the same and with the thin-tube total length "La" being varied (with a non-sealing length "Lx"

shown in FIG. 8 being gradually increased). The inventors conducted the above test on each of these experimental lamps. By increasing the non-sealing length "Lx", the ends 62 and 72, closer to the discharge space, of the bonding areas formed by the adhesive agents 8 and 9 (hereafter referred to as "metallize-sealing ends") are positioned away from the discharge space where a heat source exists. By doing so, therefore, the temperature of the metallize-sealing ends can be lowered.

It is difficult to directly measure the temperature of the metallize-sealing end. Therefore, the temperature at the surface point "P" of the thin-tube part corresponding to the metallize-sealing end (hereafter referred to as the "outer surface temperature of the metallize-sealing end") was used for the assessment. The outer surface temperature was measured at steady lighting, using a radiation thermometer with a measurement accuracy of ±3.0%.

Figure 9:
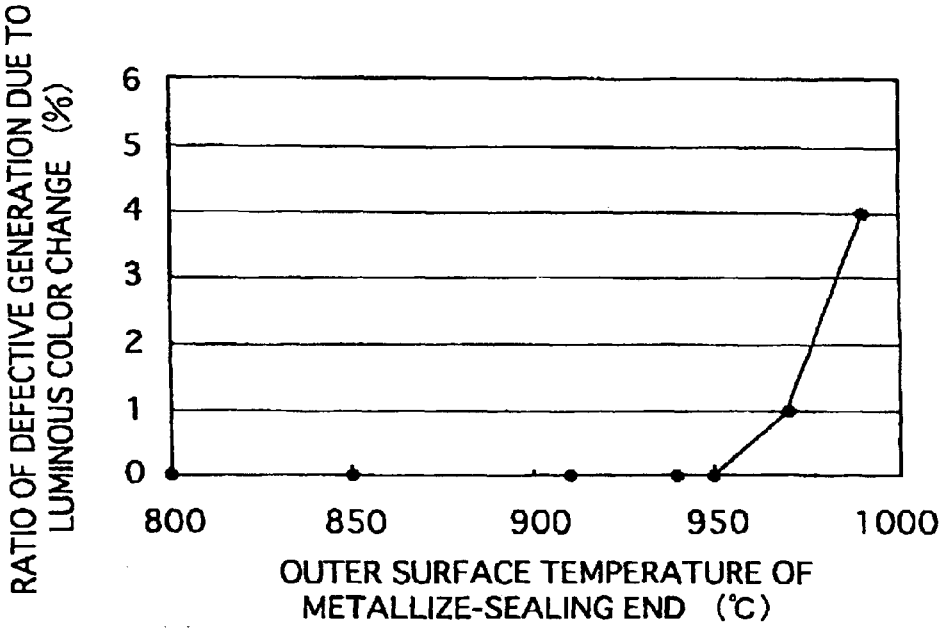
FIG. 9 is a graph showing the relationship between an outer surface temperature of a metallize-sealing end and a ratio of defective generation due to luminous color change.
Figure 10:
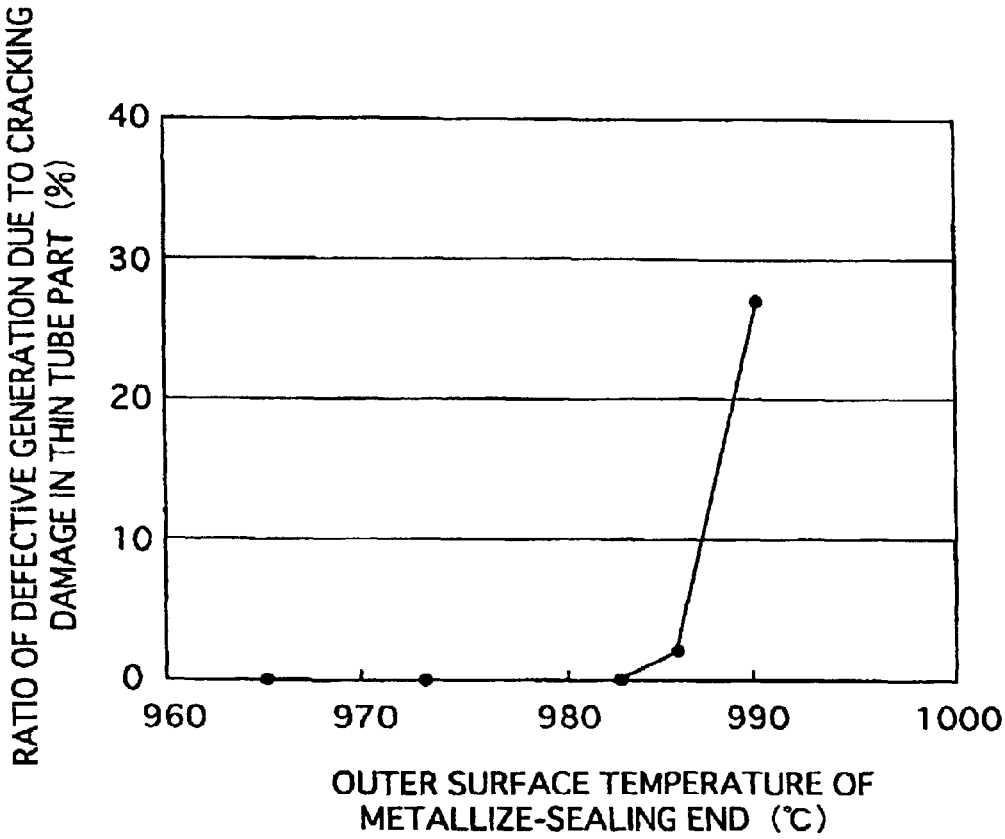
FIG. 10 is a graph showing the relationship between an outer surface temperature of a metallize-sealing end and a ratio of defective generation due to cracking damage in a thin-tube part.

FIGS. 9 and 10 show the test results. FIG. 9 is a graph showing the relationship between the outer surface temperature of the metallize-sealing end and the ratio of defective generation due to the luminescent color change. FIG. 10 is a graph showing the relationship between the outer surface temperature of the metallize-sealing end and the ratio of defective generation due to cracking damage in the thin-tube part.

As can be seen from FIG. 9, defective generation due to luminescent color change does not occur when the outer surface temperature of the metallize-sealing end is 950° C. or lower. In other words, by setting the outer surface temperature of the metallize-sealing end in such a range that does not exceed 950° C., defective generation due luminescent color change can be prevented. This can be explained as follows. The temperature of the metallize-sealing end at the time when the outer surface temperature is a little higher than 950° C. is the lowest temperature at which the erosion action of the light-emitting material on the $Dy_2O_3$—$Al_2O_3$ glass occurs (the erosion-starting temperature). To be more specific, by setting the outer surface temperature of the metallize-sealing end in such a range that does not exceed 950° C., the temperature of the metallize-sealing end can be within a range that does not exceed the lowest temperature at which the erosion action of the light-emitting material on the $Dy_2O_3$—$Al_2O_3$ glass occurs (the erosion-starting temperature). By doing so, therefore, defective generation due to luminescent color change can be prevented.

Also, as can be seen from FIG. 10, defective generation due to cracking damage in the thin-tube part does not occur when the outer surface temperature of the metallize-sealing end is approximately 983° C. or lower.

As described above, by setting the outer surface temperature of the metallize-sealing end in such a range that does not exceed 950° C., the above-described two types of defective generation can be prevented at once.

Figure 11:
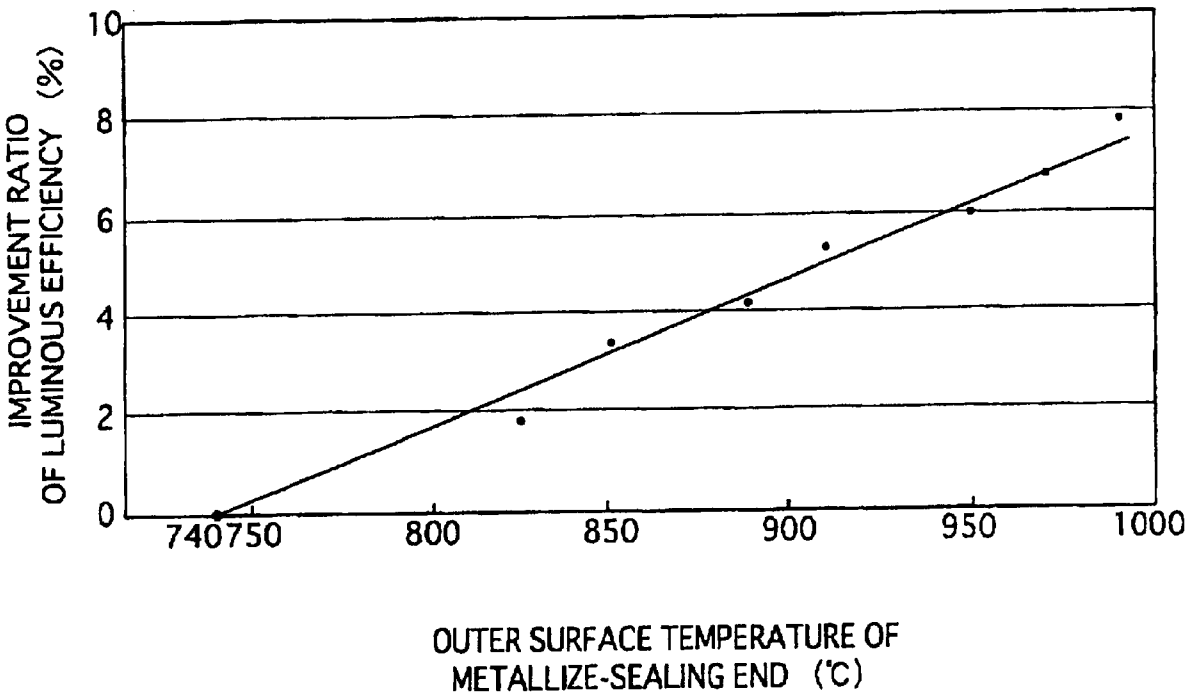
FIG. 11 is a graph showing the relationship between an outer surface temperature of a metallize-sealing end and an improvement ratio of luminous efficiency of a metal halide lamp employing a metallize-sealing technique to a metal halide lamp employing a frit-sealing technique.

The inventors of the present application also measured the luminous efficiency of each of the experimental lamps in the above test. The measurement results are shown in FIG. 11. The figure shows a graph taking the outer surface temperature of the metallize-sealing end as the horizontal axis and the improvement ratio of the luminous efficiency compared with the comparative lamp as the horizontal axis.

As can be seen from FIG. 11, the experimental lamp according to the present embodiment exhibits higher luminous efficiency by approximately 6% than the comparative lamp, even with the outer surface temperature of the metallize-sealing end being 950° C. at which the above two types of defective generation can be prevented.

Also, by setting the outer surface temperature of the metallize-sealing end at 740° C. or higher, the experimental lamp can exhibit luminous efficiency equivalent to or higher than the comparative lamp. Further, even when the luminous efficiency of the experimental lamp is equivalent to that of the comparative lamp (and of course when the luminous efficiency of the experimental lamp is equivalent to or higher than that of the comparative lamp), the sealing parts of the experimental lamp according to the present embodiment are more reliable than those of the comparative lamp due to the following reasons.

A frit used in the comparative lamp usually contains a large amount of silica or the like, in view of improving the operability at sealing and obtaining an optimum thermal expansion coefficient. However, silica easily reacts with a metal halide, and so texture destruction of the frit may occur during the effective lifetime of the lamp. As a result, the comparative lamp tends to suffer from the following problems. During the effective lifetime of the comparative lamp, cracking of the sealing parts may occur, so that the lamp cannot be lightened up. Also, a slow leakage—a phenomenon that a light-emitting material is gradually leaked outside an arc tube—may occur in the sealing parts, so that the lamp characteristics are degraded.

On the other hand, the adhesive agent used in the lamp according to the present embodiment does not contain a material like silica that is easy to react with a metal halide, and so is chemically stable to a metal halide. Therefore, the above-described problems of cracking and slow leakage are not likely to occur in the sealing parts of the lamp according to the present embodiment. Therefore, the sealing parts sealed using the metallize-sealing technique can maintain strong hermetical sealing for a longer time than the sealing parts sealed using the frit-sealing technique. As a result, a metal halide lamp employing the metallize-sealing technique has a longer life than a metal halide lamp employing the frit-sealing technique. It should be noted here that a trace amount of silica contained in the adhesive agent does not cause the above-described problems of cracking and slow leakage.

As described above, an optimum range for the outer surface temperature of the metallize-sealing end that can ensure luminous efficiency equivalent to or higher than luminous efficiency of the comparative lamp while preventing the above-described two types of defective generation is from 740° C. to 950° C. inclusive.

The luminous-efficiency comparing test described above was as to the lamps with the rated lamp wattage of 150 W. Although detailed data is not shown, the inventors of the present application conducted the same test as to lamps with rated lamp wattages varying from 70 W to 150 W, and confirmed that the same effects as above were obtained.

FIG. 12 shows the correspondence between the outer surface temperature of the metallize-sealing end and the non-sealing length "Lx" used in the above test.

As can be seen from the figure, the outer surface temperature of the metallize-sealing end is 950° C. when the non-sealing length "Lx" is 2.0 mm. Here, the distance measured in the arc tube axis direction between a metallize-sealing end and an electrode top that is closer to the metallize-sealing end is "(Lo—Le)/2+Lx=4.7 mm". Accordingly, such a range in which the outer surface temperature of the metallize-sealing end does not exceed 950° C. corresponds to a range in which the distance measured in the arc tube axis direction between the metallize-sealing end and the electrode top that is closer to the metallize-sealing end is no shorter than 4.7 mm.

Also, the outer surface temperature of the metallize-sealing end is 740° C. when the non-sealing length "Lx" is 14.0 mm. Here, the distance measured in the arc tube axis direction between a metallize-sealing end and an electrode top that is closer to the metallize-sealing end is "(Lo—Le)/2+Lx=16.7 mm". Accordingly, such a range in which the outer surface temperature of the metallize-sealing end is from 740° C. to 950° C. inclusive corresponds to a range in which the distance measured in the arc tube axis direction between the metallize-sealing end and the electrode top that is closer to the metallize-sealing end is from 4.7 mm to 16.7 mm inclusive.

The present embodiment also describes the construction that can improve the luminous efficiency while preventing cracking damage of an arc tube or luminescent color change by way of specifying the distance between the metallize-sealing end and the electrode top. However, the nature of the present invention originally lies in specifying the temperature of the metallize-sealing end, i.e., the outer surface temperature of the metallize-sealing end, at steady lighting as described above. The other parameters, e.g., the total length "La" and the non-sealing length "Lx" of the thin-tube part basically cannot be specified for the above purposes of improving the luminous efficiency while preventing cracking damage of the arc tube or luminescent color change. This is because the total length "La", the non-sealing length "Lx", or the like changes depending on the rated lamp wattage, the set tube wall loading, the basic structure of the arc tube, and the like. For example, when a high-pressure discharge lamp is used in certain fields, the tube wall loading of the arc tube is set relatively low in view of extending the lamp life. In this case, the non-sealing length "Lx" is shortened further to keep the discharge space at an optimum high temperature at the time of lighting.

(Modifications)

Although the present invention is described based on the preferred embodiments as above, the present invention should not be limited to the above embodiments. For example, the following modifications are possible.

(1) Although the first to fourth embodiments describe the case where the main-tube part and the thin-tube parts are separately prepared and then assembled together to form the arc tube, the present invention should not be limited to such. The main-tube part and the thin-tube parts may be formed integrally.

(2) Although the first to fourth embodiments describe the case where both the thin-tube parts 4 and 5 are sealed using the metallize-sealing technique with the molybdenum capillaries 6 and 7 as conductors, the present invention should not be limited to such. For example, one of the thin-tube parts may be sealed with a conductor using another method, e.g., the frit-sealing technique. The luminous efficiency of the lamp employing the metallize-sealing technique at least in one of the thin-tube parts is higher than the luminous efficiency of the lamp employing the frit-sealing technique in both of the thin-tube parts because the length of at least the thin-tube part sealed using the metallize-sealing technique can be shortened.

In the case of sealing a thin-tube part using the frit-sealing technique, a molybdenum capillary is not used but an electrode rod is held by the thin-tube part via a ceramic cement (frit).

(3) Although the first to fourth embodiments describe the case where the present invention is applied to a metal halide lamp, the present invention can be applied to other general purpose high-pressure discharge lamps such as a high-pressure mercury lamp.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A high-pressure discharge lamp, comprising:

an arc tube that is made up of a main-tube part in which a discharge space is formed, and two thin-tube parts extending from both ends of the main-tube part, the main-tube part and the two thin-tube parts being made from a translucent ceramic material; and a pair of electrodes having rods that respectively extend through the two thin-tube parts into the discharge space so that tops thereof face each other with a predetermined distance in-between, the rod of at least one of the electrodes being held by a tubular electrode holder embedded in and bonded to the thin-tube part via an adhesive agent, the electrode holder being made of a halide-resistant metal, the adhesive agent including a sintered halide-resistant metal impregnated with mixture glass, wherein the electrode holder is at such a position that satisfies the expression $$L \geqq 0.012P+2.5[\text{mm}]$$

where "L" is a distance [mm] between (a) a top of the electrode whose rod is held by the electrode holder and (b) one end of the electrode holder closer to the discharge space, and "P" is a lamp wattage [W].

2. The high-pressure discharge lamp of claim 1, further comprising a winding member that is wound at least partly around an area of the rod of the electrode that is passed through the electrode holder, the winding member being made of a halide-resistant metal.

3. The high-pressure discharge lamp of claim 2, wherein the winding member is wound in such a manner that one end of the winding member closer to the discharge space is positioned, in a tube-axis direction, between (a) the end of the electrode holder closer to the discharge space and (b) one end of the thin-tube part closer to the discharge space.

4. The high-pressure discharge lamp of claim 3, further comprising a starting aid conductor that is provided at an outer surface of the arc tube, wherein at least one end of the starting aid conductor is attached to the outer surface at such a position, in the tube-axis direction, between (a) one end of the winding member closer to the discharge space and (b) the end of the electrode holder closer to the discharge space.

5. The high-pressure discharge lamp of claim 1, wherein the sintered halide-resistant metal is a sintered metal containing molybdenum, and the mixture glass is glass containing alumina.

6. The high-pressure discharge lamp of claim 1, wherein the distance "L" is 10 [mm] or less when the lamp wattage "P" is in a range of 20 to 400 [W] inclusive.

7. The high-pressure discharge lamp of claim 1, wherein the electrode holder and the thin-tube part are bonded together by way of metallizing.

8. A high-pressure discharge lamp, comprising:

an arc tube that is made up of a main-tube part in which a discharge space is formed, and two thin-tube parts extending from both ends of the main-tube part, the main-tube part and the two thin-tube parts being made from a translucent ceramic material; and a pair of electrodes having rods that respectively extend through the two thin-tube parts into the discharge space so that tops thereof face each other with a predetermined distance in-between, the rod of at least one of the electrodes being held by a tubular electrode holder embedded in and bonded to the thin-tube part via an adhesive agent, the electrode holder being made of a halide-resistant metal, the adhesive agent including a sintered halide-resistant metal impregnated with mixture glass, wherein a temperature of one end, closer to the discharge space, of a bonding area formed using the adhesive agent does not exceed a lowest temperature at which an erosion action of a light-emitting material enclosed in the discharge space on the mixture glass occurs.

9. The high-pressure discharge lamp of claim 8, wherein when the temperature of the end of the bonding area is assessed using a surface temperature of the thin-tube part at a position corresponding to the end of the bonding area, the surface temperature is set at a temperature not exceeding 950° C.

10. The high-pressure discharge lamp of claim 9, wherein the surface temperature is 740° C. or higher.

11. The high-pressure discharge lamp of claim 8, wherein the sintered halide-resistant metal is a sintered metal containing molybdenum, and the mixture glass is glass containing alumina.

12. A high-pressure discharge lamp, comprising:

an arc tube that is made up of a main-tube part in which a discharge space is formed, and two thin-tube parts extending from both ends of the main-tube part, the main-tube part and the two thin-tube parts being made from a translucent ceramic material; and a pair of electrodes having rods that respectively extend through the two thin-tube parts into the discharge space so that tops thereof face each other with a predetermined distance in-between, the rod of at least one of the electrodes being held by a tubular electrode holder embedded in and bonded to the thin-tube part via an adhesive agent, the electrode holder being made of a halide-resistant metal, the adhesive agent including a sintered halide-resistant metal impregnated with mixture glass, wherein the adhesive agent is at such a position that is away from a top of the electrode whose rod is held by the electrode holder, by a distance that is out of a range where the mixture glass receives an erosion action of a light-emitting material enclosed in the discharge space at steady lighting.

13. The high-pressure discharge lamp of claim 12, wherein when a temperature of one end, closer to the discharge space, of a bonding area formed using the adhesive agent is assessed using a surface temperature of the thin-tube part at a position corresponding to the end of the bonding area, the adhesive agent is at such a position that the surface temperature does not exceed 950° C.

14. The high-pressure discharge lamp of claim 13, wherein the adhesive agent is at such a position that the surface temperature is 740° C. or higher.

15. The high-pressure discharge lamp of claim 12, wherein the sintered halide-resistant metal is a sintered metal containing molybdenum, and the mixture glass is glass containing alumina.

* * * * *